US005245353A

United States Patent [19]

Gould

[11] Patent Number: 5,245,353

[45] Date of Patent: Sep. 14, 1993

[54] DUAL WAVEGUIDE PROBES EXTENDING THROUGH BACK WALL

[76] Inventor: Harry J. Gould, 1649 E. Hale St., Mesa, Ariz. 85203

[21] Appl. No.: 817,765

[22] Filed: Jan. 8, 1992

Related U.S. Application Data

[63] Continuation-in-part of Ser. No. 766,209, Sep. 27, 1991, abandoned.

[51] Int. Cl.[5] ..... H01Q 13/00; H01P 1/161

[52] U.S. Cl. ..... 343/786; 333/21 A; 333/125

[58] Field of Search ..... 333/21 A, 125, 126, 333/135, 137, 251; 343/756, 786

[56] References Cited

U.S. PATENT DOCUMENTS 4,356,459 10/1982 Gould et al. ..... 333/21 A
4,414,516 11/1983 Howard ..... 333/21 A
4,595,890 6/1986 Cloutier ..... 333/21 A X
4,683,440 7/1987 Yoshikawa ..... 333/21 A X
4,851,857 7/1989 Dienes ..... 333/251 X

FOREIGN PATENT DOCUMENTS 125001 5/1988 Japan ..... 333/21 A

*Primary Examiner*—Paul Gensler

[57] ABSTRACT

Waveguide OMT, which can be utilized as an antenna feed, has two orthogonally polarized coaxial ports extending through the back wall of the waveguide. Cross coupling between the probes is minimized by locating the point of entry through the back wall and orienting each probe such that it couples to a primary waveguide mode, but does not couple to the first higher waveguide mode, or, for coaxial waveguide, does not couple to the TEM mode.

21 Claims, 1 Drawing Sheet

DUAL WAVEGUIDE PROBES EXTENDING THROUGH BACK WALL

CROSS REFERENCE TO RELATED APPLICATION

This Application is a Continuation-In-Part of application Ser. No. 07/766,209 filed Sep. 27, 1991, and now abandoned.

BACKGROUND OF THE INVENTION

1. Field of the invention

This invention relates to antenna receiving apparatus for receiving or transmitting radio signals and, more particularly for receiving or transmitting orthogonally polarized radio signals.

2. Description of the Prior Art

A crowding of the electro-magnetic frequency spectrum for the transmission of radio signals, particularly in satellite transmissions, has lead to the practice of frequency reuse, which allows for a double use of the frequency spectrum by simultaneously transmitting two signals using the same frequency bandwidth, but with their polarizations oriented at ninety degrees, or in an orthogonal relationship, to each other.

One mechanism for transmitting or receiving orthogonally polarized signals is to use an Ortho-Mode Transducer or OMT, which is used to couple two orthogonally polarized signals to a common junction. The OMT can be constructed with the common and the two orthogonal ports as waveguide ports, or with the common port as waveguide and the two orthogonal ports as coaxial ports, or with the common port as waveguide and one orthogonal port as waveguide and the other orthogonal port as coaxial. The common junction is usually constructed of waveguide and is an integral part of the feed in antenna systems.

Waveguide transmission lines come in an assortment of types including circular, square, elliptical, rectangular, and coaxial with the most commonly used types for OMTs being either circular or square. Since waveguides can support a multitude of transmission modes, the cross-sectional dimensions of the waveguide are normally selected such that only the lowest order or primary mode is allowed to propagate within the desired frequency band. In circular waveguide the TE11 mode is the primary mode with the TM01 mode as the first higher order mode. Each mode will have its own electric field (E-Field) and magnetic field (H-Field) arrangement. The other waveguide types, including square and coaxial, have similar types of modes with their own unique designations.

Waveguide modes are described as either TE for Transverse-Electric or TM for Transverse-Magnetic modes. The expression transverse is used to describe fields which are orthogonal to the direction of propagation. For example a TE mode in a waveguide would have its electric fields arranged such that they were orthogonal to the direction of propagation or the longitudinal axis of the waveguide. The numbers following TE or TM such as TM01 designate the order of the mode. A third type of mode is the TEM for Transverse Electro-Magnetic mode which is a non waveguide mode and can only propagate between two conductors which do not have contact with each other. The TEM mode has both its electric and magnetic fields transverse to the direction of propagation. The TEM mode is the mode of propagation for coaxial cable, micro-strip board, and stripline board. Since only one TEM mode exists, no numbers are used to describe the order of the mode.

Coaxial waveguides differ from the other waveguide shapes in that they have an outer and a center conductor which can support the coaxial mode in addition to the waveguide modes. The coaxial mode, which is often referred to as the TEM mode or Transverse Electro-Magnetic mode, is not a waveguide mode and can propagate in coaxial waveguide independent of the waveguide dimensions. Coaxial waveguides come in a variety of cross-sectional shapes including circular, square, elliptical, and rectangular. Since the coaxial or TEM mode is dependent on the presence of a center conductor, it does not exist in the other waveguide configurations discussed in the previous paragraphs.

Two types of probes are commonly used to couple signals from a waveguide transmission line to coaxial lines. The first is an electric field (E-Field) probe, which passes through the waveguide wall and extends into, but does not contact, the waveguide, such that it is aligned with or parallel to the electric fields of the primary mode in the waveguide. The second probe type is the magnetic field (H-Field) probe, which passes through the waveguide wall and extends into the waveguide where it is grounded to the waveguide wall forming a magnetic coupling loop. It is aligned such that the magnetic fields pass through the grounded loop. The electric field probes are normally preferred because they are simpler to construct and usually perform better than the magnetic field probes. However, the principles of this invention apply equally to both E-Field and H-Field probes.

A common method for constructing dual probe OMTs is to have two E-Field probes enter through the sidewalls of the waveguide. The two probes are located in separate planes normal to the waveguide axis and will be situated in a ninety degree or orthogonal relationship to each other. Typically, a first probe will be located one-quarter of a wavelength from the back wall, while the second probe will be three-quarters of a wavelength from the back wall.

When receiving signals, this arrangement can present difficulties, since it is often desirable to have both signals routed to the same circuit board where the low-noise amplifiers ("LNA's") are located, or to a switch which alternately switches the first and the second probe to a single LNA. The line length between each probe and its LNA must be minimized to preserve the lowest noise figure possible for the system. Furthermore, the probes will tend to be limited by narrow band responses, particularly the one located the greater distance from the back wall.

When two or more probes are located in the same axial plane, they usually interact with each other, causing the signal from one probe to couple to the other probe(s). The mechanism for this cross coupling is usually the excitation of higher order modes, which can be excited as non-propagating or evanescent modes. An E-Field probe extending through the side wall of a circular waveguide will tend to excite the TM01 mode in addition to the primary or TE11 mode. Since the TM01 mode has electric fields which are aligned with both probes, cross coupling can result. Since the TM01 mode is a non-propagating mode in most cases, the second probe can be isolated by positioning it some distance away from the first probe.

Donald C. Cloutier (U.S. Pat. No. 4,595,890) discloses two E-Field probes extending through the back wall of a circular waveguide. This probe arrangement normally would suffer from cross coupling. However, in Cloutier's case each probe is in turn deactivated by diode switches located in the waveguide and connected directly to the probes.

Mon N. Wong et al (U.S. Pat. No. 4,965,868), by positioning four co-planar E-Field probes in a circular waveguide, was able to minimize the problem of cross coupling. Since each of the four probes will excite the TM01 mode along with the TE11 mode, there will be substantial cross coupling between all four probes. However, with the use of four probes, Wong is able to eliminate the cross-coupled component in a summing network connected to each diagonal pair of probes.

Hiroshi Kume et al (Japan Pat. #56-8301) recognized the benefits of routing the E-Field probes through the back wall of a circular waveguide. However, Kume, like Wong, resorted to the use of four probes and summing networks to minimize the effects of cross coupling between the probes.

SUMMARY OF THE INVENTION

The present invention allows two orthogonal probes, each extending through the back wall of a waveguide, to be arranged such that they couple to orthogonal primary waveguide modes (TE11 in circular waveguide) but are substantially orthogonal to the first higher order mode (TM01 mode in circular waveguide). In coaxial waveguide the probes are arranged such that they couple to orthogonal primary TE11 waveguide modes but are substantially orthogonal to the coaxial or TEM mode. Interaction and cross coupling between probes arranged in such a manner is minimized.

The present invention incorporates two orthogonal probes extending through the back wall of a waveguide OMT such that each probe interacts only with a primary waveguide mode, thus minimizing the interaction or cross coupling between the probes.

Among the objects of the present invention are the following:

To provide new and useful waveguide apparatus;

To provide new and useful waveguide apparatus having two probes extending through the back wall of the waveguide;

To provide new and useful waveguide apparatus having a plurality of conductors connected to a pair of probes; and To provide new and useful apparatus for receiving radio signals.

DETAILED DESCRIPTION OF THE PREFERRED EMBODIMENTS

Figure 1:
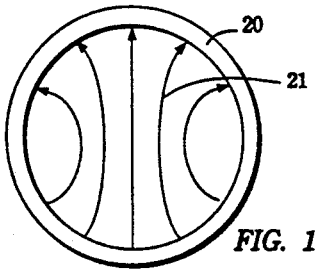
FIG. 1 is a prior art drawing showing a cross sectional view of the electric fields of a TE11 mode in a circular waveguide.

FIG. 1 shows the arrangement of the electric fields of a primary, TE11, mode 21 in a circular waveguide 20. Circular waveguide will simultaneously support two orthogonal TE11 modes. The first mode is shown in FIG. 1, while a second TE11 will look identical to the first mode, but will have its electric fields rotated ninety degrees about the axis of the waveguide.

Figure 2:
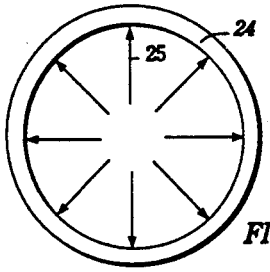
FIG. 2 is a prior art drawing showing a cross sectional view of the electric fields of the TM01 mode in a circular waveguide.

FIG. 2 shows the arrangement of the electric fields for the TM01 mode 25 in a circular waveguide 24. The TM01 mode is the first higher order mode from the TE11 mode. Since the TM01 has circular symmetry, only one TM01 mode can exist in the waveguide.

Examples of prior art feeds are shown in FIGS. 3, 4, 5, and 6.

Figure 3:
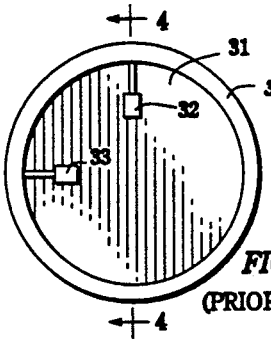
FIG. 3 (PRIOR ART)
FIG. 3 is a front view of a prior art OMT with two electric field probes situated in a circular waveguide.
Figure 4:
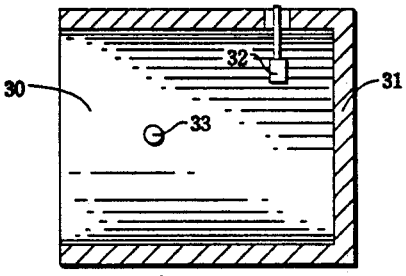
FIG. 4 (PRIOR ART)
FIG. 4 is a view in partial section of the prior art OMT of FIG. 3 taken generally along line 4—4 of FIG. 3.

FIGS. 3 and 4 show a prior art OMT with a circular waveguide 30 with a back wall 31 as the common port with conductive probes 32 and 33 extending through the side wall of the circular waveguide 30. Probe 32 is oriented at ninety degrees to probe 33, such that the two probes are orthogonal to each other. The probes in FIG. 4 are spaced approximately one-half wavelength apart to minimize interaction between the probes.

Figure 5:
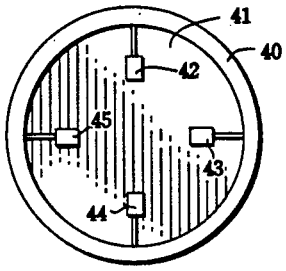
FIG. 5 (PRIOR ART)
FIG. 5 is a front view of a second prior art OMT with four probes extending through the side wall of a circular waveguide and with the four probes located in the same axial plane.

FIG. 5 shows a second prior art OMT with a circular waveguide 40 with a back wall 41 as the common port and with conductive probes 42, 43, 44, and 45 extending through the side wall of the waveguide 40.

Figure 6:
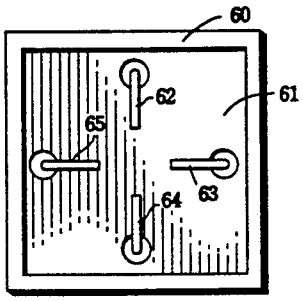
FIG. 6 (PRIOR ART)
FIG. 6 is a front view of a third prior art OMT with four probes extending through the rear wall of a square waveguide.

FIG. 6 shows a third prior art OMT with a square waveguide 60 and a back wall 61 as the common port with probes 62, 63, 64, and 65 extending through the back wall 61.

Figure 7:
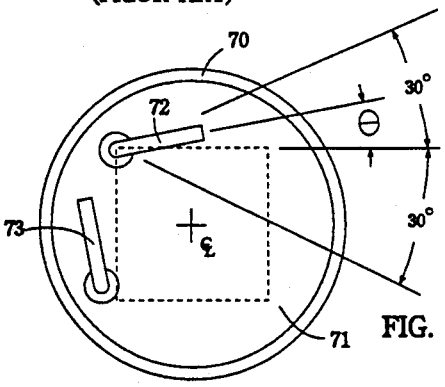
FIG. 7 is a front view of an OMT embodying the present invention.

FIG. 7 embodies the present invention and shows a circular waveguide 70 with a back wall 71 and with conductive E-Field probes 72 and 73 extending through the back wall 71. The object of the present invention is to position probes 72 and 73 such that they are substantially orthogonal to the electric fields of the TM01 circular mode, and at the same time have each probe aligned with orthogonal TE11 modes. With the probes placed in this position, they do not interact with the TM01 mode, causing the cross coupling between probes 72 and 73 to be minimized.

For minimum interaction, the position of entry through the back wall 71 needs to be positioned away from the center of the back wall in that space that can be defined as an annular ring with its outer radius equal to the radius of the back wall 71 and its inner radius approximately equal to ⅓ the radius of the back wall 71. Once a position is selected, the angular position of the probe needs to be adjusted to select that angle where the probe is orthogonal to the TM01 mode, and at the same time aligned with a TE11 mode.

In addition to the electric fields 25 shown in FIG. 2, the TM01 mode has electric fields which are parallel to the axis of the waveguide. However, these fields are concentrated along the axial center of the waveguide and are very weak near the side wall of the waveguide. Since most probes extending through the back wall of a waveguide OMT will have axial components, particularly at the point of entry into the waveguide, it is important that the probes enter the waveguide at a point near the side wall.

The angle, $\theta$, can be defined to lie within approximately $\pm 30$ degrees of an angle whose apex lies on a corner of a square, which corner is located at the center of the region where the probe enters through the back wall. The center of the square is concentric with the center of the back wall. The zero degree reference position of the angle, $\theta$, is defined to lie along the adjacent side of the said square.

The same principle is used to locate the position of entry and the angular position for a second probe. It is not necessary that both probes are located equal distance from the center point of the back wall and that they have the same offset from their respective reference angles. However, they need to be oriented substantially orthogonal to each other.

Figure 8:
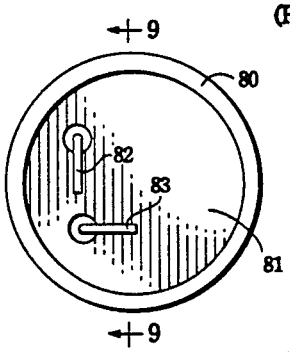
FIG. 8 is another view of the OMT in FIG. 7 but with differently oriented probes.

FIG. 8 is an embodiment of the present invention, showing an OMT with a circular waveguide 80 and a back wall 81 with probes 82 and 83 oriented such that they are orthogonal to the TM01 mode. Probe 82 is aligned with a TE11 mode, while probe 83 is aligned with a second TE11 mode which is orthogonal to probe 82. With proper positioning and orientation, the probes will be orthogonal to the TM01 mode and at the same time orthogonal to each other.

Figure 9:
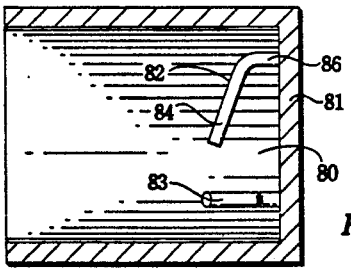
FIG. 9 is a side view in partial section taken generally along line 9—9 of FIG. 8.

FIG. 9 is a view in partial section of the OMT shown in FIG. 8. Probe 82 has a conductor 86 which enters the waveguide 80 through the back wall 81 and is parallel to the axis of the waveguide 80. Conductor 84 is attached to conductor 86 at an oblique angle. Probe 83, likewise, extends through back wall 81 and is similarly disposed in waveguide 80.

Figure 10:
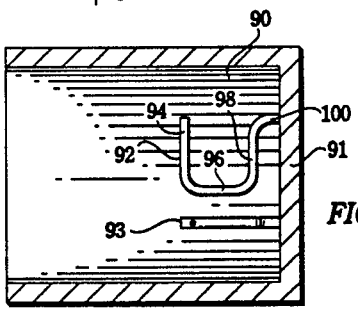
FIG. 10 is a side view in partial section illustrating an alternate embodiment of the apparatus of FIG. 8.

FIG. 10 is an alternate embodiment of the OMT shown in FIG. 9 with each probe having four sections. Probe 92 is composed of conductor 100 which is connected to conductor 98 which in turn is connected to conductor 96 which in turn is connected to conductor 94. Conductor 100 is substantially parallel to the axis or side wall of waveguide 90 and extends into the waveguide through back wall 91, and conductor 98 is substantially parallel to back wall 91, and conductor 96 is substantially parallel to the side wall of waveguide 90, and conductor 94 is substantially parallel to back wall 91. Probe 93 extends through back wall 91 and is similarly disposed in waveguide 90.

Since there are many shapes of probes that will perform satisfactorily, the application of this invention is not limited to the probe shapes shown in this application. Furthermore, the second probe can be of a different shape than the first probe.

Figure 11:
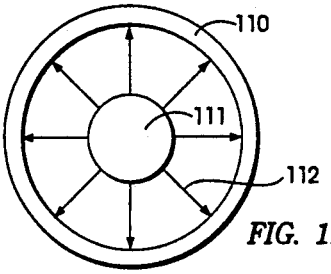
FIG. 11 is a view of the coaxial or TEM mode in coaxial waveguide.

FIG. 11 shows a section of coaxial waveguide and the arrangement of the electric fields of the TEM or coaxial mode in the waveguide. Both the outer section and the inner section of the waveguide are made of conductive material. As the TEM mode propagates along the waveguide the inner conductor will be of opposite polarity from the outer conductor.

Figure 12:
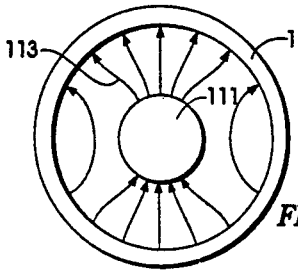
FIG. 12 is a view of a primary waveguide or TE11 mode in coaxial waveguide.

FIG. 12 shows a section of coaxial waveguide and the arrangement of the electric fields of the coaxial TE11 waveguide mode. Both negative and positive charges are disposed on the surfaces of the inner conductor and the outer conductor.

Figure 13:
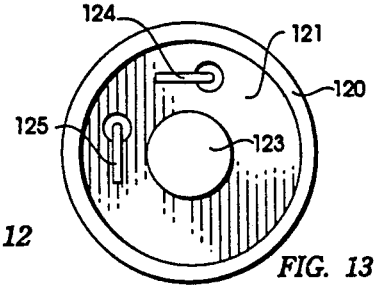
FIG. 13 is a view of two probes in coaxial waveguide embodying the present invention.

FIG. 13 embodies the present invention and shows how two orthogonal probes, 124 and 125, can be disposed in a coaxial waveguide with outer conductor 120, inner conductor 123, and back wall 121, to couple to orthogonal TE11 modes, and at the same time both probes are orthogonal to the TEM or coaxial mode. The same rules for adjusting the probes as discussed for FIG. 7 apply to dual probes in coaxial waveguide.

Generally, the same rules apply to the application of this invention to other waveguide shapes such as square, elliptical, rectangular, waveguides with ridges, or irregular shapes. The rules, also, apply to coaxial waveguides of various shapes and to coaxial waveguides where the outer conductor may be of a different shape from the inner conductor.

What I claim is:

1. Waveguide apparatus, comprising, in combination:

waveguide means for receiving polarized radio signals, having a back wall and a longitudinal axis;

first probe means extending through the back wall for coupling to a primary electro-magnetic waveguide mode and oriented to be substantially orthogonal to at least one first higher-order electro-magnetic waveguide mode;

second probe means extending through the back wall for coupling to a second primary electro-magnetic waveguide mode and oriented to be substantially orthogonal to at least one first higher-order electro-magnetic waveguide mode and oriented to be substantially orthogonal to the first probe.

2. The apparatus of claim 1 in which the waveguide means includes a circular cross-sectional configuration in which the primary modes are the $TE_{11}$ mode and the first higher-order mode is the $TM_{01}$ mode.

3. The apparatus of claim 1 in which the waveguide means includes a square cross-sectional configuration in which the primary modes are the $TE_{10}$ mode and the first higher-order modes are the $TE_{11}$ mode and the $TM_{11}$ mode.

4. The apparatus of claim 1 in which the first probe means includes:

a first conductor substantially parallel to the axis of the waveguide means and extending through the back wall, and a second conductor connected to the first conductor at an oblique angle to the first conductor, and which second conductor extends generally in an axial direction into the waveguide means.

5. The apparatus of claim 1 in which the first probe means includes:

a first conductor substantially parallel to the axis of the waveguide means and extending through the back wall, and a second conductor connected to the first conductor and is substantially parallel to the back wall, and a third conductor connected to the second conductor and is substantially parallel to the axis of the waveguide means (waveguide axis), and a fourth conductor connected to the third conductor and is substantially parallel to the back wall.

6. Waveguide apparatus, comprising, in combination:

waveguide means for receiving polarized radio signals, including a back wall having an outer edge and a geometric center;

first probe means extending through the back wall at a position which is bounded by the outer edge of the back wall and about two thirds the distance from the outer edge to the geometric center of the back wall, said first probe means positioned to couple to a first primary electro-magnetic waveguide mode and oriented to be substantially orthogonal to at least one first higher-order electro-magnetic waveguide mode;

second probe means extending through the back wall at a position which is bounded by the outer edge of the back wall and two thirds the distance from the outer edge to the geometric center of the back wall, said second probe means positioned to couple to a second primary electro-magnetic waveguide mode and oriented to be substantially orthogonal to at least one first higher-order electro-magnetic waveguide mode and substantially orthogonal to the first probe means.

7. The apparatus of claim 6 in which the waveguide means includes a circular cross-sectional configuration and the primary modes are the $TE_{11}$ mode and the first higher-order mode is the $TM_{01}$ mode.

8. The apparatus of claim 6 in which the waveguide means includes a square cross-sectional configuration and the primary modes are the $TE_{10}$ mode and the first higher-order modes are the $TE_{11}$ mode and the $TM_{11}$ mode.

9. The apparatus of claim 6 in which the first probe means includes:

a first conductor substantially parallel to the axis of the waveguide means and extending through the back wall, and a second conductor connected to the first conductor at an oblique angle to the first conductor, and which second conductor extends generally in an axial direction into the waveguide means.

10. The apparatus of claim 6 in which the first probe means includes:

a first conductor substantially parallel to the axis of the waveguide means and extending through the back wall, and a second conductor connected to the first conductor and is substantially parallel to the back wall, and a third conductor connected to the second conductor and is substantially parallel to the axis of the waveguide means, and a fourth conductor connected to the third conductor and is substantially parallel to the back wall.

11. Waveguide apparatus, comprising, in combination: waveguide means for receiving polarized radio signals, having a back wall and a longitudinal axis;

first probe means extending through the back wall for coupling to a primary electro-magnetic waveguide mode and oriented to be substantially orthogonal to at least one first higher-order electro-magnetic waveguide mode;

second probe means extending through the back wall for coupling to a second primary electro-magnetic waveguide mode.

12. The apparatus of claim 11 in which the waveguide means includes circular cross-sectional configuration and the primary modes are the $TE_{11}$ mode and the first higher-order mode is the $TM_{01}$ mode.

13. The apparatus of claim 11 in which the waveguide means includes a generally square cross-sectional configuration and the primary modes are the $TE_{10}$ mode and the first higher-order modes are the $TE_{11}$ and the $TM_{11}$ mode.

14. Waveguide apparatus, comprising, in combination:

coaxial waveguide means for receiving polarized radio signals, having a back wall and a longitudinal axis;

first probe means extending through the back wall for coupling to a primary electro-magnetic waveguide mode and oriented to be substantially orthogonal to the transverse electro-magnetic mode;

second probe means extending through the back wall for coupling to a second primary electro-magnetic waveguide mode and oriented to be substantially orthogonal to the transverse electro-magnetic mode and oriented to be substantially orthogonal to the first probe.

15. The apparatus of claim 14 in which the coaxial waveguide means includes a circular cross-sectional configuration and the primary waveguide modes are the $TE_{11}$ mode.

16. The apparatus of claim 14 in which the coaxial waveguide means includes a square cross-sectional configuration.

17. Waveguide apparatus, comprising, in combination:

coaxial waveguide means for receiving polarized radio signals, having a back wall and a longitudinal axis;

first probe means extending through the back wall for coupling to a primary electro-magnetic waveguide mode and oriented to be substantially orthogonal to the transverse electro-magnetic mode;

second probe means extending through the back wall for coupling to a second primary electro-magnetic waveguide mode.

18. The apparatus of claim 17 in which the coaxial waveguide means includes a circular cross-sectional configuration and the primary waveguide modes are the $TE_{11}$ mode.

19. The apparatus of claim 17 in which the coaxial waveguide means includes a square cross-sectional configuration.

20. The apparatus of claim 17 in which the first probe means includes:

a first conductor substantially parallel to the axis of the waveguide means and extending through the back wall, and a second conductor connected to the first conductor at an oblique angle to the first conductor, and which second conductor extends generally in an axial direction into the waveguide means.

21. The apparatus of claim 17 in which the first probe means includes:

a first conductor substantially parallel to the axis of the waveguide means and extending through the back wall, and a second conductor connected to the first conductor and is substantially parallel to the back wall, and a third conductor connected to the second conductor and is substantially parallel to the axis of the waveguide means, and a fourth conductor connected to the third conductor and is substantially parallel to the back wall.

* * * * *